US008307599B2

(12) United States Patent
Jenkins et al.

(10) Patent No.: US 8,307,599 B2
(45) Date of Patent: Nov. 13, 2012

(54) MOLDED SHINGLES WITH MOISTURE GUARDS FOR FASTENERS AND WITH SHINGLE ALIGNMENT FEATURES

(75) Inventors: Robert L. Jenkins, HoneyBrook, PA (US); Gregory F. Jacobs, Oreland, PA (US)

(73) Assignee: CertainTeed Corporation, Valley Forge, PA (US)

( * ) Notice: Subject to any disclaimer, the term of this patent is extended or adjusted under 35 U.S.C. 154(b) by 172 days.

(21) Appl. No.: 12/834,218

(22) Filed: Jul. 12, 2010

(65) Prior Publication Data

US 2012/0005978 A1 Jan. 12, 2012

(51) Int. Cl.
*E04D 1/00* (2006.01)

(52) U.S. Cl. ..... 52/533; 52/544; 52/550; 52/553

(58) Field of Classification Search ..... 52/520, 52/533, 534, 544, 550, 552, 553, 478, 518
See application file for complete search history.

(56) References Cited

U.S. PATENT DOCUMENTS

| | | | | |
|---|---|---|---|---|
| 3,458,962 | A * | 8/1969 | Kendall | 52/309.1 |
| 4,102,106 | A * | 7/1978 | Golder et al. | 52/533 |
| 4,914,885 | A * | 4/1990 | Baker et al. | 52/520 |
| 5,072,562 | A * | 12/1991 | Crick et al. | 52/533 |
| 5,076,037 | A * | 12/1991 | Crick et al. | 52/520 |
| 5,224,318 | A * | 7/1993 | Kemerer | 52/521 |
| 5,249,402 | A * | 10/1993 | Crick et al. | 52/533 |
| 5,950,387 | A * | 9/1999 | Stahl et al. | 52/559 |
| 6,808,785 | B1 | 10/2004 | Friedman et al. | |
| 7,141,200 | B2 | 11/2006 | MacKinnon et al. | |
| 7,141,201 | B2 | 11/2006 | Kim et al. | |
| 7,716,894 | B2 | 5/2010 | Jolitz | |
| 2005/0252138 | A1* | 11/2005 | Griman | 52/521 |
| 2006/0032174 | A1* | 2/2006 | Floyd | 52/518 |
| 2007/0011978 | A1* | 1/2007 | Kalkanoglu et al. | 52/518 |

FOREIGN PATENT DOCUMENTS

WO WO2008/052029 A2 5/2008

* cited by examiner

*Primary Examiner* — Brian Glessner
*Assistant Examiner* — Brian D Mattei
(74) *Attorney, Agent, or Firm* — Paul & Paul

(57) ABSTRACT

A molded synthetic polymer based shingle is provided as is a roof made up of underlying and overlying of courses of such shingles. The shingles are generally rigid and are provided with upwardly protruding moisture guards on the upper surfaces of their headlap portions, for guarding against wind-blown moisture entering fastener locations at which fasteners are used to attach shingles to a roof. The moisture guards may be of various configurations and by either completely or incompletely surround the fastener locations. Shields having recesses for receiving moisture guards therein, or other downward projections, may be provided at under surface locations of the shingles in cooperative engagement for further protection against moisture penetration and for facilitating alignment of shingles relative to other shingles.

18 Claims, 7 Drawing Sheets

MOLDED SHINGLES WITH MOISTURE GUARDS FOR FASTENERS AND WITH SHINGLE ALIGNMENT FEATURES

BACKGROUND OF THE INVENTION

In the shingle art, it is known to make molded shingles that have the appearance of natural materials, such as slate, for example, in that natural-appearing surface configurations can be molded into a shingle, to simulate the natural materials. Such shingles may be constructed in accordance with any of U.S. Pat. Nos. 7,141,200; 7,141,201; 6,808,785 and published International Application WO 2008/052029, the complete disclosures of which are herein incorporated by reference.

Such shingles are generally rigid and are molded of a polymer based material.

When such shingles are laid up on a roof, in courses, wind driven moisture including rain, snow and even moist air can be driven to the fastener locations, traveling along relatively smooth or textured surfaces of the shingles. Such moisture can infiltrate around fasteners that are used to fasten the shingles to a roof. Generally, such fasteners, such as nails, staples or the like penetrate fastener locations of the shingles, in order to fasten the shingles to a roof. Such fastener locations generally include depressions in the upper surfaces of the shingles. Usually, such depressions in shingles have little or no drainage facilities. Over extended periods of time such fasteners, generally of metal construction, when contacted with moisture, can experience degradation of the fastener, such as rusting, oxidation, or other degradation.

THE PRESENT INVENTION

The present invention is directed to blocking wind-driven moisture from the fastener locations, by incorporating a raised or upwardly protruding moisture guard, that protrudes upwardly from the top surface of the shingle. Because the fasteners are applied through the shingles in the shingles headlap portions, the moisture guards are present likewise in the headlap portions of the shingles. Preferably, such moisture guards at least partially or completely surround the fastener locations, for deflecting moisture from the fastener locations.

SUMMARY OF THE INVENTION

The present invention is directed to providing a molded synthetic shingle having tab and headlap portions, with at least one fastener location in a headlap portion, and with a molded moisture guard protruding upwardly from the top surface of the headlap portion of the shingle, at least partially surrounding the at least one fastener location, for deflecting moisture from that fastener location.

It is therefore an object of this invention to provide a shingle in accordance with the summary of the invention described above.

It is a further object of this invention to provide a shingle, wherein there are at least two fastener locations on the top surface of the headlap portion of the shingle, with each such fastener location having a moisture guard.

It is a further object of this invention, to accomplish the above objects, wherein moisture guards completely surround associated fastener locations.

It is yet another object of this invention to accomplish the above objects, wherein each moisture guard has an upwardly opening recess therein for receiving the head of a fastener in the recess, and wherein there is a penetrable bottom in the recess through which a fastener may pass.

It is a further object of this invention to accomplish the above object, wherein the bottom side of the headlap portion of the shingle is provided with an optional bottom recess located beneath the upwardly opening recesses of each of the moisture guards.

It is another object of this invention to accomplish the objects above, wherein each moisture guard has a through-hole therein for receiving a portion of a fastener therethrough.

It is another object of this invention to provide a moisture guard for the upper surface of a molded synthetic shingle, wherein the bottom side of the tab portion of the shingle is provided with a downwardly protruding projection carried thereby, and with each such projection optionally being a shield having a downwardly opening recess therein for cooperative engagement with an upwardly protruding moisture guard on the top surface of the headlap portion of an underlying shingle, when the shingles are in an installed condition on a roof.

It is a further object of this invention to accomplish the above object, wherein the cooperative engagement is in the form of at least partial reception of a moisture guard of an underlying shingle in the recess of an associated shield of an overlying shingle. Such an arrangement, in addition to effectively functioning as a moisture guard to prevent moisture access to a fastener, also enables shingles in overlying courses to be properly aligned with shingles in underlying courses, and additionally, can help interlocking shingles in underlying and overlying courses via the molded interlocking components being in cooperation with each other.

It is a further object of this invention, wherein associated projections and moisture guards of overlying and underlying shingles facilitate proper alignment of shingles in overlying and underlying courses of shingles.

It is yet another object of this invention to provide a roof constructed of a plurality of shingles in accordance with the objects above.

Other objects and advantages of the present invention will be readily understood from a reading of the following brief description of the drawing figures, the detailed descriptions of the preferred embodiments, and the appended claims.

BRIEF DESCRIPTIONS OF THE DRAWING FIGURES

Figure 11:
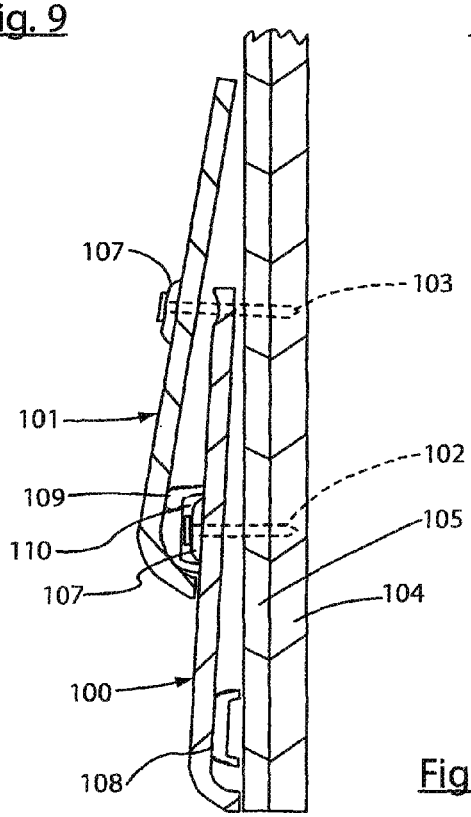
FIG. 11 is an illustration similar to that of FIG. 4, but wherein the undersurface of the tab portion of each shingle is provided with downwardly protruding projections in the form of shields with recesses therein for receiving upwardly protruding moisture guards of an underlying shingle in recesses of an overlying shingle, in the installed condition.
Figure 11A:
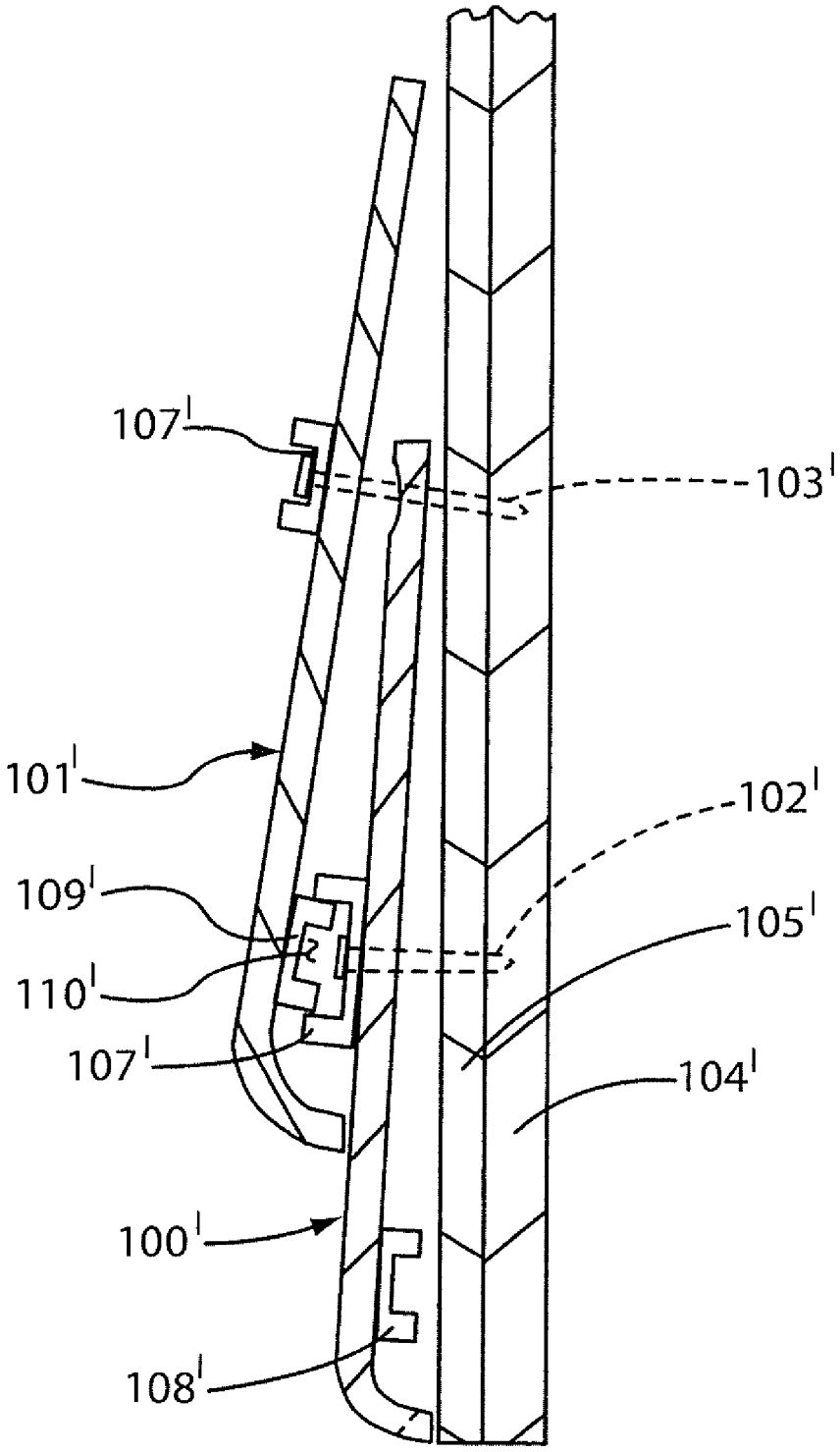
FIG. 11A is an illustration similar to that of FIG. 11, but wherein the tab portion of each shingle is provided with downwardly protruding projections of an overlying shingle that are received within recesses of an upwardly protruding moisture guard of an underlying shingle, in the installed condition.
Figure 11B:
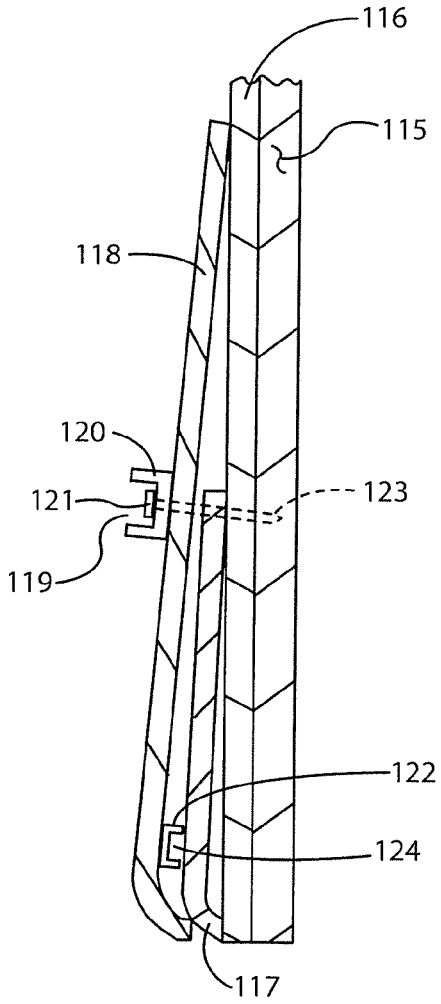
FIG. 11B is an illustration also similar to that of FIG. 11A, but wherein the underlying shingle is a starter shingle.
Figure 11C:
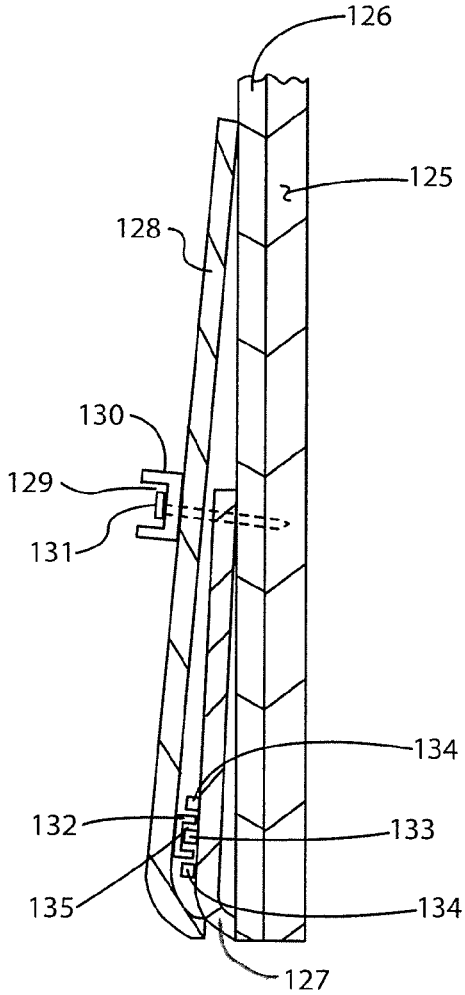
FIG. 11C is an illustration similar to that of FIG. 11B, but wherein there is an interlocking arrangement on the outer surface of the starter shingle, in cooperative engagement with a projection on the inside surface of the overlying shingle.
Figure 11D:
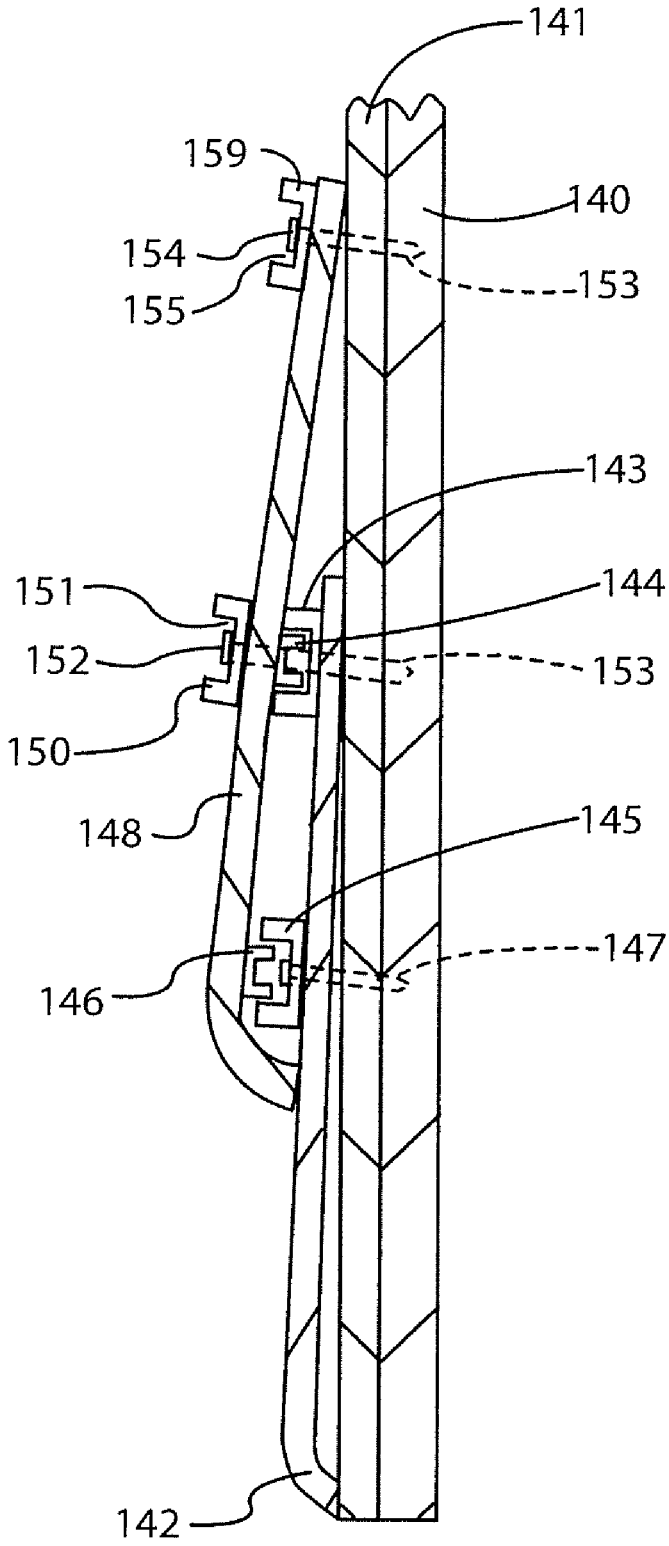

FIG. 11D is an illustration similar to that of FIG. 11A, but wherein the upper end of the outer surface of the underlying shingle is in interlocked engagement with a projection on the under surface of the overlying shingle, so that the overlying shingle and each successive overlying shingle in successive overlying courses will have four interlocking engagement locations, to facilitate proper alignment, two of which locations are laterally spaced from each other, and with two other engagement locations being vertically spaced above the lower, laterally spaced engagement locations.

FIGS. 12 through 19 are fragmentary illustrations of headlap portions of shingles in accordance with this invention, with different geometric configurations for the moisture guards.

DETAILED DESCRIPTIONS OF THE PREFERRED EMBODIMENTS

Figure 1:
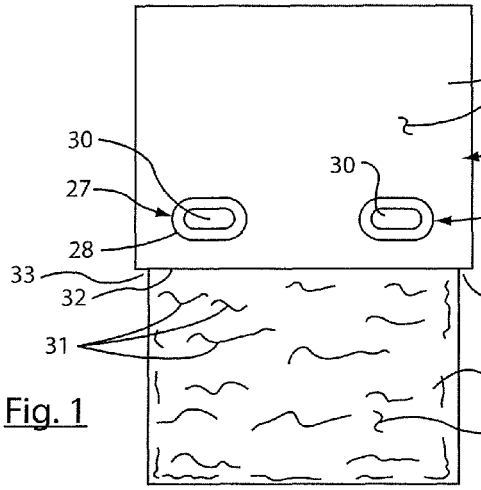
FIG. 1 is a top plan view of a molded synthetic shingle in accordance with this invention, having headlap and tab portions, and with oval shaped moisture guards on a portion of the upper surface of the headlap portion of the shingle.
Figure 2:
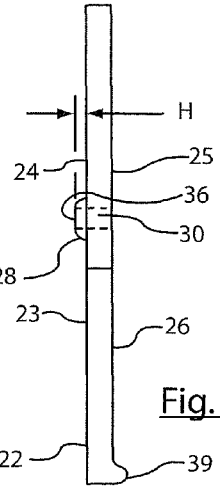
FIG. 2 is a right side view of the shingle of FIG. 1.

Referring now to the drawings in detail, reference is first made to FIG. 1, wherein a shingle 20 is generally illustrated, having a headlap portion 21 and a tab portion 22. The upper surface of the shingle 20, as shown in FIG. 2, has an upper surface portion 23 for the tab portion, and an upper surface portion 24 for the headlap portion. The headlap portion has a lower or downwardly facing surface 25, when the shingle is installed on a roof, and the tab portion 22 has a downwardly facing surface 26 when the shingle 20 is in stalled on a roof.

A plurality, generally two, of preferably molded moisture guards 27 appear protruding upwardly from the upper surface portion 24 (which is outwardly as shown in FIG. 2, but which would be upwardly when the shingle 20 is in installed condition on a roof). Each moisture guard in the illustration of FIG. 1 comprises an oval configuration 28 surrounding a fastener location 30. In the embodiment illustrated in FIGS. 1 and 2, the fastener location 30 comprises a through-hole. The upper surface 23 of the tab portion 22 of the shingle 20 is preferably provided with texture in the form of various configurations 31, to simulate a natural substance such as slate, cedar shakes, tiles, or other natural materials. Preferably, the tab portion 22 of the shingle is of a narrower width than the headlap portion 21, being cut back at 33, 34 in the vicinity of a separation line 32 that separates the tab and headlap portions. The particular type of molding of the moisture guards to the shingle can include, for example, press molding, injection molding, compression molding, calendering, and/or blow molding.

Also, preferably, as shown in FIG. 2, the lower end 39 of the tab portion 22 of the shingle is rightwardly curved as shown in FIG. 2, to facilitate the shingle 20 being engaged against a roof at the end 39 in the installed condition.

As shown, for example, in FIG. 1, the headlap portion 21 has a vertical height that is greater than the vertical height of the tab portion 22, with the tab portion extending from the lower edge of the shingle 20, up to the separation line 32, and with the headlap portion extending from the upper edge of the shingle 20, down to the separation line 32. The fastener locations 30 are above the separation line 33, and are spaced inside the right and left edges of the headlap portion 21, as shown, in the lower left and lower right corners of the headlap portion 21.

Figure 3:
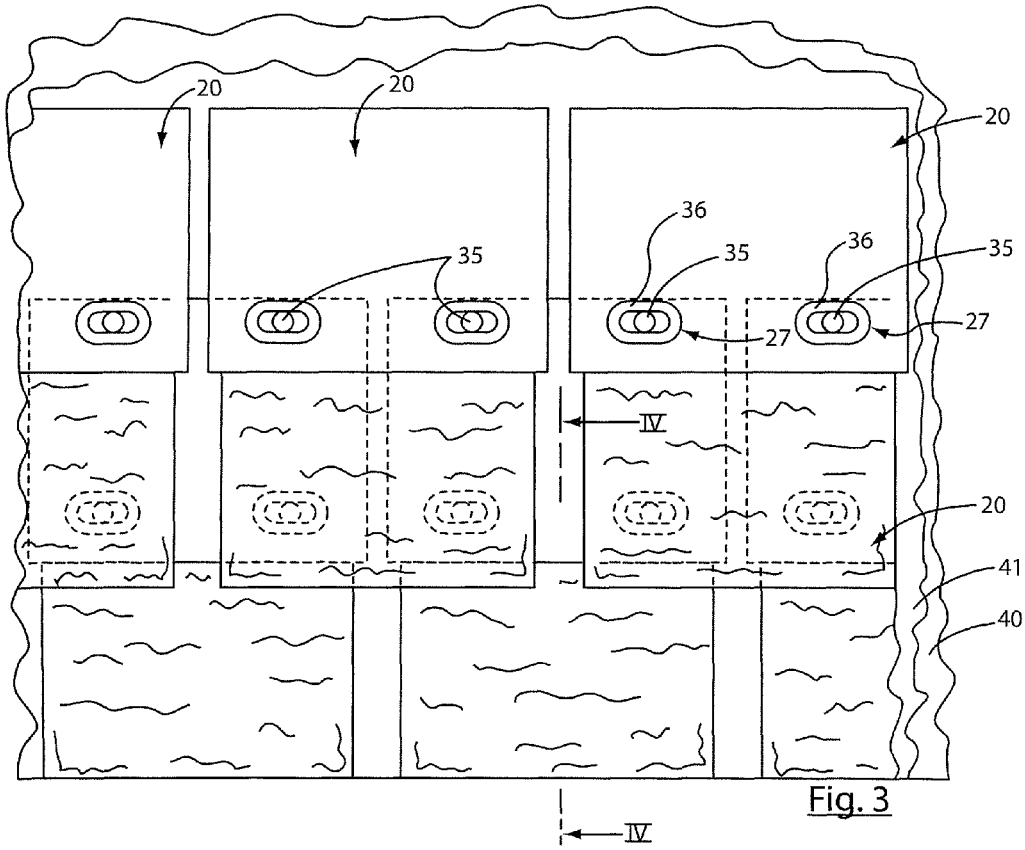
FIG. 3 is an enlarged fragmentary illustration of a roof deck, with an underlayment shown thereover, and with a plurality of shingles of this invention laid up in courses, with tab portions of the shingles being illustrated to be weather-exposed in the installed condition.

While each fastener location 30 of the shingle of FIGS. 1 and 2 is shown as being a through-hole, such that fasteners such as nails 35 can have their heads engaged against outer surfaces 36 of the moisture guards 27, as shown in FIG. 3, it will also be understood that, alternatively, the shingles 20 could be provided with penetrable bottoms, capable of being broken through when fasteners 35 are applied for fastening the shingles 20 to roofs, as will be discussed hereinafter, with respect to other embodiments of shingles. The greater the height "H" of the moisture guard, as shown in FIG. 2, the greater the moisture guard's effectiveness is likely to be, in keeping moisture away from fasteners and avoiding fastener corrosion, particularly if the roof has a low (more flat or more horizontal) slope.

In FIG. 3, it will be seen that the shingles 20 are applied to a roof deck 40 of wood or the like, that has an underlayment 41 of a protective sheet such as plastic film, tar paper or the like, prior to the shingles 20 being applied as discussed above.

Figure 4A:
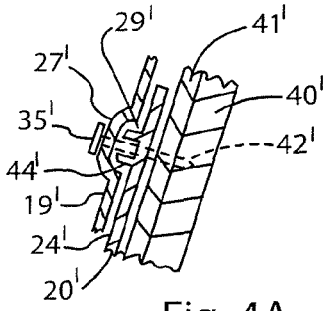
FIG. 4A is a fragmentary detail view of another optional configuration for the zone IVA of FIG. 4, oriented as it would ordinarily be for a sloped roof.
Figure 4:
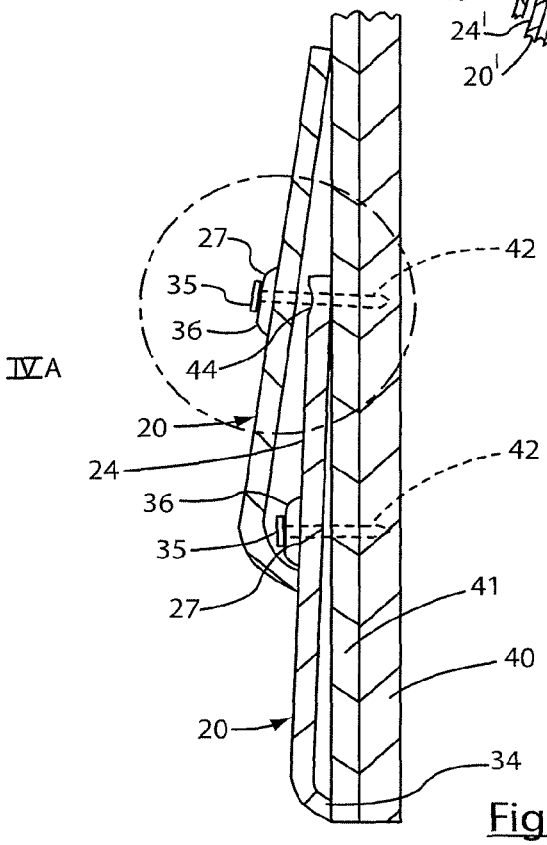
FIG. 4 is a fragmentary illustration of some of the shingles of FIG. 3, taken generally along the line IV-IV of FIG. 3.

With reference now to FIG. 4, it will be seen that fasteners 35 in the form of nails have their heads engaged against the leftmost surfaces 36 of the moisture guards 27, with the shanks 42 of the nails engaging the shingles through the underlayment 41, to the roof deck 40.

It will be understood that, throughout this application, the moisture guards 27 that are illustrated as protruding leftwardly from the outer surfaces 24 of the headlap portions 21 of the shingles 20 would be generally upwardly protruding when the shingles are installed on a generally sloped roof, and that the shanks 42 of the nails that are used to install the shingles would extend downwardly into the roof.

Also, with reference to FIG. 4, it will be seen that at the upper end of the headlap portion of the lowermost shingle 20, there is provided a reduced thickness portion 44 that forms another fastener location. Such reduced thickness portion 44 can thus comprise a nailing zone or fastening zone, and could be provided with ribs, serrations, or the like, or could take on any of the configurations set forth in International Application WO 2008/052029 referenced above, to facilitate fastening a shingle in an overlying course of shingles through a shingle in an underlying course of shingles, at two vertically spaced apart locations as is shown in FIG. 4.

Referring now to FIG. 4A, it will be seen that the sloped roof deck 40' has an underlayment 41' thereon, and has molded into the upper surface 24' of the shingle 20', a moisture guard 44', upstanding from the surface 24'. The next-overlying shingle 19' has a leftwardly or upwardly protruding protrusion 27' and the lower surface of the shingle 19' has a recess 29' therein, generally complementally configured with the upper surface 27', to receive the moisture guard 44' of the underlying shingle 20' therein. The head 35' of a fastener 42' passes through the upwardly protruding surface 27', through the shingle 19', into the recess of the upstanding moisture guard 44', through the underlayment 41', and into the roof deck 40'. It will be understood that a plurality, preferably at least two such arrangements as are illustrated in FIG. 4A, may be provided for each overlying shingle that overlies an underlying shingle, of overlying and underlying courses.

When a pair of arrangements for shingles such as are illustrated in FIG. 4A are provided, generally in the headlap portions of overlying and underlying shingles in overlying and underlying courses, such provides a means of interlocking shingles in overlying and underlying courses, to assure proper alignment of shingles in a given course, with shingles in an underlying course.

Figure 5:
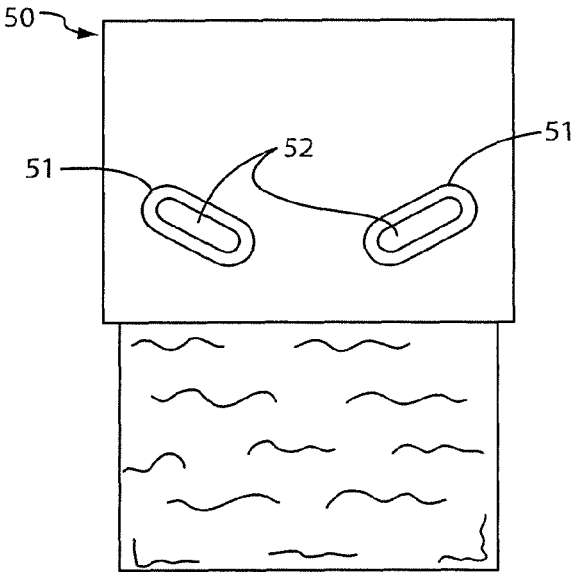
FIG. 5 is a plan view of a shingle of the type of FIG. 1, but wherein the moisture guards have a different orientation in the shingle of FIG. 5, relative to that of FIG. 1, and wherein the moisture guards are of an angled oval configuration.

With reference to FIG. 5, it will be seen that another shingle 50 is provided, generally similar to the shingle 20 of FIG. 1, but wherein the moisture guards 51 thereof comprise angularly disposed oval configurations.

In FIG. 6, the shingle 60, again is constructed similarly to the shingle 20 of FIG. 1, but wherein the moisture guards 61 are of oval configurations, but generally horizontally oriented. It will be understood that the moisture guards 61, shown in FIG. 6, while being generally horizontally oriented, could, alternatively, be vertically oriented (not shown) such that the long side of the oval configurations would essentially be rotated about 90° from the orientation illustrated in FIG. 6.

It will further be understood that the moisture guards 27, 51 and 61 are constructed to completely surround the respective fastener locations 30, 52, 62, but that, if desired, moisture guards could only partially surround such fastener locations, if desired, for example, leaving a portion of the fastener locations, preferably at the lower ends of the moisture guards, incompletely surrounded.

Figure 7:
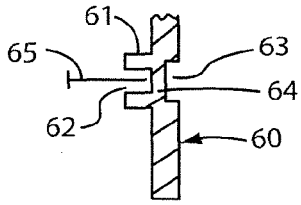
FIG. 7 is a fragmentary illustration, taken through one of the moisture guards of FIG. 6, generally along the line VII-VII of FIG. 6.

In FIG. 7, the fragmentary cross-section of the shingle 60 is shown, having a recess 63 on the right side thereof, disposed rightwardly of the location of the moisture guard 61. The fastener location 62 is shown as having a penetrable bottom 64, through which a nail 65 may readily penetrate because the recess 63 allows for the bottom 64 of the fastener location 62 being made sufficiently thin for ready penetration by the shank of the nail 65. It will be understood that, in the installed condition of the shingle 60, the recess 63 is downwardly facing, and that the moisture guard 61 is upwardly facing.

Figure 8:
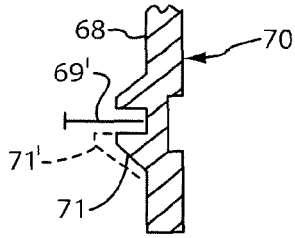
FIG. 8 is a fragmentary illustration similar to that of FIG. 7, but wherein the moisture guard has a different configuration, and is in the form of a sloped crown-like configuration.

With reference to FIG. 8, it will be seen that the fragmentary portion illustrated for a shingle 70 has a moisture guard 71 that is in the form of a conically sloped crown-like configuration 71, with other features of the shingle of FIG. 8 thereof being similar to the features described above with respect to the embodiment of FIG. 7, which need not be duplicated by description herein. In FIG. 8, an optional configuration is provided at 71', for the lower or down-roof side of the papered surface 71 of the moisture guard, in that by having the down-roof side of the moisture guard higher, or extending farther away from the upper surface 69 of the shingle 70, there is less opportunity for water or other moisture to enter into the vicinity of the fastener 69', and therefore there is less opportunity for the fastener 69' to corrode due to moisture entering beneath an overlying shingle in an overlying course (not shown in FIG. 8).

Figure 6:
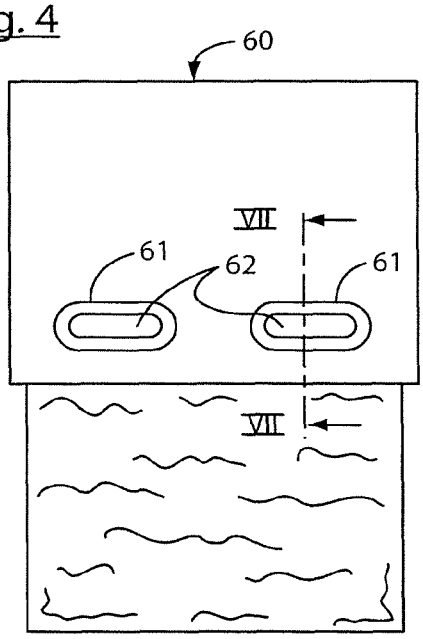
FIG. 6 is an illustration similar to that of FIG. 1, but wherein the moisture guards of the shingle comprise generally horizontally oriented ovals.
Figure 9:
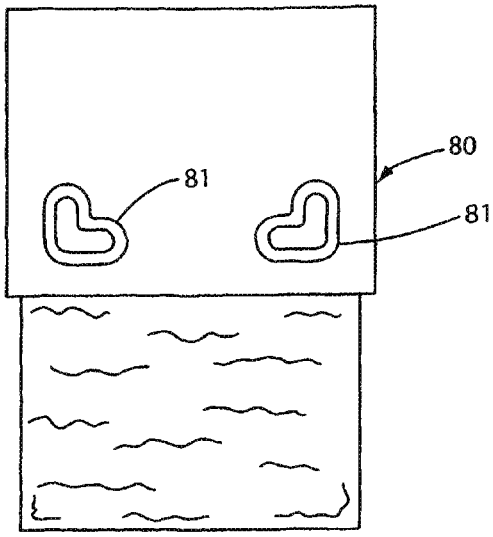
FIG. 9 is an illustration similar to that of FIG. 1, but wherein the moisture guards have yet another alternative configuration.

With reference to FIG. 9, it will be seen that a shingle 80 is illustrated, having moisture guards 81 of L-shaped configuration, as illustrated, but wherein the shingle 80 is otherwise similarly constructed to any of the embodiments of FIGS. 1, 5 and 6 described above.

Figure 10:
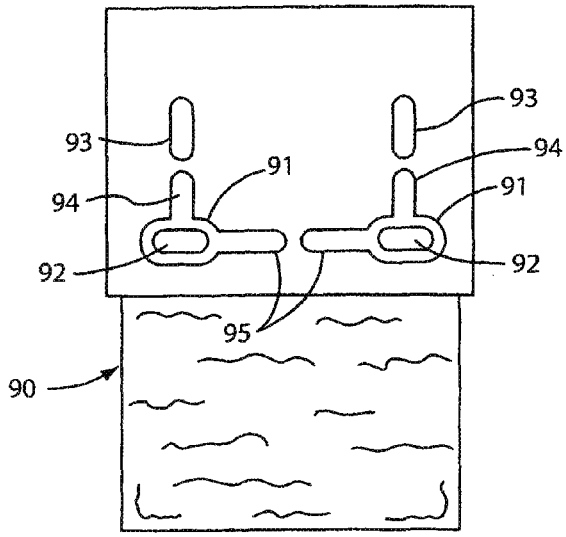
FIG. 10 is an illustration similar to that of FIG. 1, but wherein the moisture guards have yet other alternative configurations, being comprised of oval configurations and straight line configurations.

In FIG. 10, a shingle 90 is illustrated, having moisture guards 91 that completely surround the fastener locations 92, but with additional portions of moisture guards 93, 94, being vertically oriented, and other portions of moisture guards 95 being horizontally oriented, for further protection against wind-driven moisture when shingles 90 are installed on a roof.

With reference now to FIG. 11, shingles 100 and 101 of respective lower and upper adjacent courses of shingles are shown, secured by means of fasteners 102, 103 to a roof deck 104 through an underlayment 105. The shingles 100 and 101 are provided with moisture guards 107, similar to the moisture guards 27 illustrated in FIG. 4, but the shingles 100 and 101 are also provided with downward projections in the form of shields 108, 109, on the undersides of the shingles 100 and 101, respectively, at the lower ends of the tab portions thereof, preferably molded integrally with their respective shingles 100 and 101, but with the shields 108, 109, being adapted to cooperatively engage moisture guards of shingles in a next-underlying course of shingles wherever there is a next-underlying course of shingles. For example, the shield 109 is adapted to receive, in a downwardly opening recess 110 thereof, the moisture guard 107 illustrated in FIG. 11 for the shingle 100 in a next-underlying course of shingles. This arrangement allows for effecting proper alignment of shingles when shingles in an overlying course are applied with their tab portions overlying headlap portions of shingles in a next-underlying course, by giving the installer a visual means for placement of shingles in an overlying course relative to shingles in a next-underlying course, with such reception of moisture guards in shields also providing an interlocking engagement of shingles in adjacent courses.

In FIG. 11A, shingles 100' and 101' of respective lower and upper adjacent courses of shingles are shown, secured by means of fasteners 102', 103' to a roof deck 104' through an underlayment 105'. The shingles 100' and 101' are provided with moisture guards 107', and the shingles 100' and 101' are also provided with moisture guards 108', 109' on the undersides of shingles 100' and 101', respectively, at the lower ends of the tab portions thereof, preferably integrally molded with the respective shingles 100' and 101', but with the moisture guards 107' being adapted to cooperatively engage the downward projections 109' of shingles in a next-overlying course of shingles wherever there is a next underlying course of shingles. For example, a downward projection 109' is adapted to be received in an upwardly opening recess 110' of the moisture guard 107' carried by the underlying shingle 100'. This arrangement, like the arrangement of FIG. 11, also allows for effecting proper alignment of shingles when shingles in an overlying course are applied with their tab portions overlying headlap portions of shingles in a next-underlying course, by giving the installer a visual means for placement of shingles in an overlying course relative to shingles in a next-underlying course, with such reception of downward projections in moisture guards also providing an interlocking engagement of shingles in adjacent courses, although in a somewhat opposite arrangement to the arrangement illustrated in FIG. 11.

Referring now to FIG. 11B, it will be seen that the roof deck 115 has an underlayment 116 thereon and a starter shingle 117 is provided along the lower edge of the roof, such starter shingle 117 being slightly more than one half the vertical height of the shingle 118 of the first full course of shingles. A projection 122 having a recess 124 therein is projecting rightwardly from the inner surface of the shingle 118, against the outer surface of the starter shingle 117. At the lower end of the headlap portion of the shingle 118, a moisture guard 120 is carried by the shingle 118, having a fastener head 121 in a recess 119 thereof, which fastener 123 then passes through the shingle 118, the upper end of the starter shingle 117, through the underlayment 116, and into the roof deck 115, as shown.

With reference now to FIG. 11C, a roof deck 125 is provided with an underlayment 126 thereover, and a starter shingle 127 is fastened to the roof deck by a fastener 131 the head of which sits in recess 129 of moisture guard 130 carried by the lower end of the headlap portion of a shingle 128 in the first full course of shingles, similar to the shingle 118 of FIG. 11B.

However, in the illustration of FIG. 11C, an interlock is provided by means of a projection 133, projecting leftward from the outer surface of the starter shingle 127, into a recess 135 of a rightward projection 132 carried by the shingle 128, for interlocking engagement between the starter shingle 127 and the shingle 128 in a next-overlying course. Additionally, an optional further projection 134, cylindrical in nature, is carried by the lower end of the outer surface of the starter shingle 127, for further or alternative interlocking engagement about the periphery of the projection 132 carried by the lower end of the shingle 128.

With particular reference now to FIG. 11D, a roof deck 140 is provided with an underlayment 141, and a shingle 142 is provided, in a first course of shingles, with the shingle 142 being a full height shingle. Another shingle 148 in a next-overlying course is shown to the left of the shingle 142.

In the embodiment illustrated in FIG. 11D, an additional interlocking feature is provided between shingles 142 in an underlying course, and shingles 148 in an overlying course, in the form of a double interlock vertically spaced, for each shingle. A projection 146 from the right side of the shingle 148, projects into a recess of a moisture guard 145 carried at the lower end of the headlap portion of the shingle 142, and a fastener 147 fastens the shingle 142 through the moisture guard 145, through the underlayment 141, and into the roof deck 140. A similar interlock is provided above the just-described interlock, in the form of a projection 144 from the right side of the shingle 148, into a recess of a moisture guard 143 carried from the left side of the shingle 142, at the upper end thereof. Another moisture guard 150 is carried on the left side of the shingle 148, having the head 152 of a fastener 153 in a recess 151 thereof, with the fastener projecting through the rightward projection 144, through the moisture guard 143, through the underlayment 141, and into the roof deck 140.

Another interlock in the form of a projection like that 146 into a recess of a moisture guard like that 145, would be disposed laterally of the projection 146 and moisture guard 145, such that each shingle 142 would have two laterally spaced such interlocks (not shown). Above such interlocks, a pair of laterally spaced interlocks exist (not shown) like those formed by the projection 144 into the recess of a moisture guard 143, fastened via a fastener 153 such that each shingle 142 and its overlying shingle 148 would have four interlocks, to assure proper alignment for each shingle. Thus, each shingle that is applied to the roof would have four fastener locations, each interlocking with a shingle in either a next underlying course, or a shingle in a next-overlying course.

At the upper end of the shingle 148, another moisture guard 159 is provided, having a fastener head 154 of a fastener 153 disposed in a recess thereof, fastening the upper end of the shingle 148 to the roof, as shown, through the underlayment 141. When a shingle in a next-overlying course is applied above the upper half of the shingle 148, such shingle would likewise have four locations of interlocking engagement with the shingle 148, in the same manner that shingle 148 has four locations of interlocking engagement with the shingle 142. Successive courses of shingles would likewise have four locations of interlocking engagement with shingles in underlying courses.

It will be apparent from the foregoing, that the illustrations of FIGS. 4, 11, 11A, 11B, 11C and 11D, which show the roof decks in vertical orientation, are essentially shown for purposes of illustrating the various components in the relationships to each other, but that in most instances, the roof decks would be at some angle reflecting the slope of the roof, as for example, as is shown in the fragmentary illustration for FIG. 4A.

Figure 12:
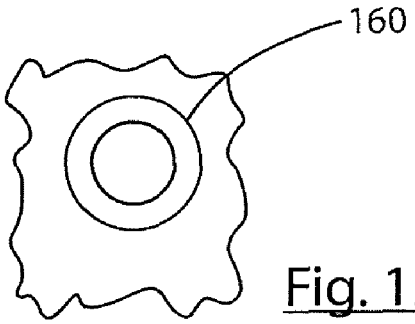
Figure 13:
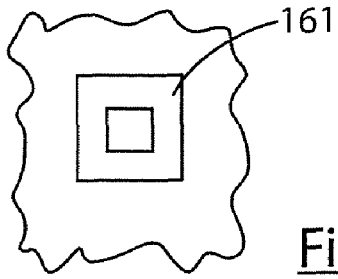
Figure 14:
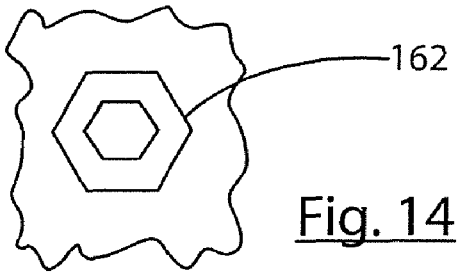
Figure 15:
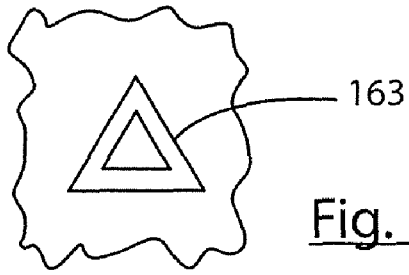
Figure 16:
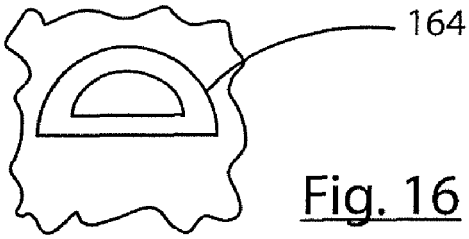
Figure 17:
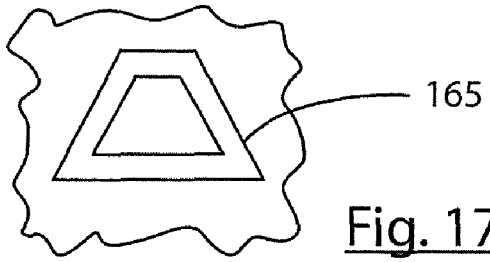
Figure 18:
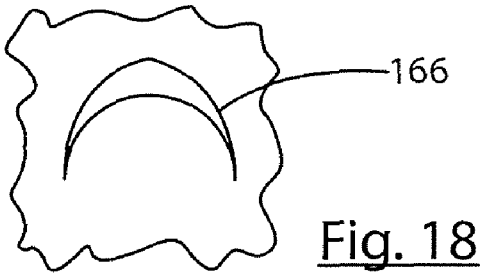
Figure 19:
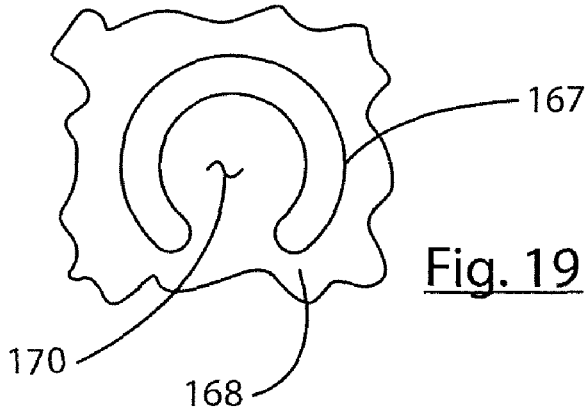

In FIGS. 12 through 19, fragmentary illustrations of different configurations are provided for the moisture guards. In FIG. 12, a circular configuration 160 is provided; in FIG. 13 a generally rectangular configuration 161 is illustrated; in FIG. 14 a generally hexagonal configuration 162 is illustrated; in FIG. 15 a generally triangular configuration 163 is illustrated; in FIG. 16 a generally semi-circular configuration 164 is illustrated; in FIG. 17 a generally trapezoidal configuration 165 is illustrated; in FIG. 18 a generally crescent-shaped configuration 166 is illustrated; and in FIG. 19, an arcuate configuration 167 is illustrated that has an opening 168 at the lower end thereof, such that the moisture guard 167 incompletely surrounds the fastener location 170 thereof, allowing for downward discharge of rain or other moisture via opening 168 when shingles having such moisture guards are installed on a roof.

It will be apparent from the foregoing that various modifications may be made in the details of construction, as well as in the fastening and assembly of shingles in accordance with this invention, to a roof, all within the spirit and scope of the invention as defined in the appended claims.

What is claimed is:

1. A molded synthetic shingle having a lower edge and an upper edge and having:

(a) a tab portion of a first height extending from the lower edge of the shingle and being adapted to be weather-exposed in the installed condition on a roof;

(b) a headlap portion of a second height, greater than said first height and extending from the upper edge of the shingle, with the headlap portion being adapted to be weather-unexposed in the installed condition on a roof, with the headlap portion being of greater width between right and left edges of the headlap portion than the width between right and left edges of the tab portion;

(c) the shingle having a top side and a bottom side; with the bottom side being adapted to be applied toward a roof in the installed condition on a roof;

(d) with the headlap portion including a top surface on the top side of the shingle;

(e) a plurality of fastener locations on the top surface of the headlap portion of the shingle near to and above the tab portion and spaced inside the right and left edges of the headlap portion; and (f) a molded moisture guard protruding upwardly from the top surface of the headlap portion of the shingle, at least partially surrounding each fastener location, for deflecting moisture from the at least one fastener location; and (g) wherein the bottom side of the tab portion of the shingle is provided with downwardly protruding projections carried thereby, with each downwardly protruding projection comprising means for cooperative engagement with an upwardly protruding moisture guard on the top surface of the headlap portion of an associated other shingle.

2. The shingle of claim 1, wherein there are at least two fastener locations on the top surface of the headlap portion of the shingle, with each said fastener location having a said moisture guard of clause (f) associated therewith.

3. The shingle of claim 2, wherein each said moisture guard completely surrounds its associated fastener location.

4. A roof comprising a plurality of shingles according to claim 2, laid up in a plurality of courses, with a plurality of shingles in each course, with shingles in next-overlying courses covering headlap portions of shingles in next-underlying courses and with the tab portions of the shingles being weather-exposed in the installed condition on a roof, with side edges of the tab portions of adjacent shingles in a given course being spaced apart from each other.

5. A roof according to claim 4, wherein each upwardly protruding moisture guard has an upwardly opening recess therein for receiving the head of a fastener in the recess, and wherein there is a penetrable bottom in the recess through which a fastener may pass, with the penetrable bottom comprising a said fastener location.

6. A roof according to claim 5, wherein the bottom side of the headlap portion of the shingle is provided with bottom recesses located beneath the upwardly opening recesses of the upwardly protruding moisture guards.

7. A roof according to claim 4, wherein each said moisture guard has a through-hole therein for receiving a portion of a fastener therethrough.

8. The shingle of claim 1, wherein each moisture guard has an upwardly opening recess therein for receiving a fastener in the recess, and wherein there is a penetrable or at least partially open bottom in the recess through which a fastener may pass, with the penetrable or at least partially open bottom comprising a said fastener location.

9. The shingle of claim 8, wherein the bottom side of the headlap portion of the shingle is provided with bottom recesses located beneath the upwardly opening recesses of the moisture guards.

10. The shingle of claim 1, wherein each moisture guard has an upwardly opening recess at least partially surrounded by an upwardly protruding portion of the guard, and the guard being adapted to receive a head of a fastener thereagainst, and with a penetrable or at least partially open bottom in the recess through which a fastener may pass, with the penetrable or at least partially open bottom comprising a fastener location.

11. The shingle of claim 1, with each downwardly protruding projections being adapted to be received within a protruding moisture guard on the top surface of the headlap portion of an associated other shingle.

12. The shingle of claim 1, wherein the shingle moisture guards comprise shapes that are any one of:

(a) circular configurations;
(b) oval configurations;
(c) rectangular configurations;
(d) triangular configurations;
(e) hexagonal configurations;
(f) trapezoidal configurations;
(g) semi-circular configurations;
(h) crescent-shaped configurations; and
(i) arcuate configurations.

13. A roof comprising a plurality of shingles according to claim 1, laid up in a plurality of courses, with a plurality of shingles in each course, with shingles in next-overlying courses covering headlap portions of shingles in next-underlying courses and with the tab portions of the shingles being weather-exposed in the installed condition on a roof, with side edges of the tab portions of adjacent shingles in a given course being spaced apart from each other.

14. A method of providing a roof covering, the method comprising;

(a) providing a plurality of shingles according to claim 1;
(b) attaching a first course of the shingles to a roof with fasteners applied through moisture guards; and
(c) attaching an overlying second course of shingles to the roof with fasteners applied through moisture guards, with moisture guards of the first course of shingles in alignment with the downwardly protruding projections of shingles of the second course.

15. A molded synthetic shingle having a lower edge and an upper edge and having:

(a) a tab portion of a first height extending from the lower edge of the shingle and being adapted to be weather-exposed in the installed condition on a roof;
(b) a headlap portion of a second height, greater than said first height and extending from the upper edge of the shingle, with the headlap portion being adapted to be weather-unexposed in the installed condition on a roof, with the headlap portion being of greater width between right and left edges of the headlap portion than the width between right and left edges of the tab portion;
(c) the shingle having a top side and a bottom side; with the bottom side being adapted to be applied toward a roof in the installed condition on a roof;
(d) with the headlap portion including a top surface on the top side of the shingle;
(e) a plurality of fastener locations on the top surface of the headlap portion of the shingle near to and above the tab portion and spaced inside the right and left edges of the headlap portion; and
(f) a molded moisture guard protruding upwardly from the top surface of the headlap portion of the shingle, at least partially surrounding each fastener location, for deflecting moisture from the at least one fastener location, and
(g) wherein there are at least two fastener locations on the top surface of the headlap portion of the shingle, with each said fastener location having a said moisture guard of clause (f) associated therewith wherein the bottom side of the tab portion of the shingle is provided with downwardly protruding projections carried thereby, with each downwardly protruding projection having a downwardly opening recess therein comprising means for cooperative engagement with an upwardly protruding moisture guard on the top surface of the headlap portion of an associated other shingle.

16. The shingle of claim 15, wherein said cooperative engagement is in the form of at least partial reception of moisture guards of associated other shingles in the recesses of said downwardly protruding projections.

17. The shingle of claim 15, wherein each downwardly protruding projection and its associated moisture guard comprise means facilitating proper alignment of shingles in next-overlying courses with shingles in next-underlying courses when shingles are installed in courses on a roof.

18. A roof comprising a plurality of molded synthetic shingles having:

(b) a headlap portion adapted to be weather-unexposed in the installed condition on a roof;

(c) the shingle having a top side and a bottom side; with the bottom side being adapted to be applied toward a roof in the installed condition on a roof;

(d) with the headlap portion including a top surface on the top side of the shingle;

(e) at least one fastener location on the top surface of the headlap portion of the shingle; and (f) a molded moisture guard protruding upwardly from the top surface of the headlap portion of the shingle, at least partially surrounding the at least one fastener location, for deflecting moisture from the at least one fastener location;

(g) with the shingles being laid up in a plurality of courses, with a plurality of shingles in each course, with shingles in next-overlying courses covering headlap portions of shingles in next-underlying courses and with the tab portions of the shingles being weather-exposed in the installed condition on a roof, wherein the bottom side of the tab portion of the shingle is provided with downwardly protruding shields carried thereby, with each shield having a downwardly opening recess therein for cooperative engagement with an upwardly protruding moisture guard on the top surface of the headlap portion of a shingle in a next-underlying course of shingles.

* * * * *